US009833796B2

(12) United States Patent
Bourgeois

(10) Patent No.: US 9,833,796 B2
(45) Date of Patent: Dec. 5, 2017

(54) SYSTEM AND METHOD FOR EVAPORATIVE COOLING OF A HEATED APPARATUS

(71) Applicant: Mark Bourgeois, Mandeville, LA (US)

(72) Inventor: Mark Bourgeois, Mandeville, LA (US)

( * ) Notice: Subject to any disclaimer, the term of this patent is extended or adjusted under 35 U.S.C. 154(b) by 416 days.

(21) Appl. No.: 14/501,242

(22) Filed: Sep. 30, 2014

(65) Prior Publication Data

US 2015/0096317 A1 Apr. 9, 2015

Related U.S. Application Data

(60) Provisional application No. 61/886,211, filed on Oct. 3, 2013.

(51) Int. Cl.

| | |
|---|---|
| ***B05B 1/20*** | (2006.01) |
| ***B05B 15/06*** | (2006.01) |
| ***A62C 3/00*** | (2006.01) |
| ***F28C 3/00*** | (2006.01) |
| *F28D 5/02* | (2006.01) |

(52) U.S. Cl.

CPC ..... *B05B 1/207* (2013.01); *A62C 3/006* (2013.01); *B05B 15/061* (2013.01); *F28C 3/005* (2013.01); *F28D 5/02* (2013.01)

(58) Field of Classification Search

CPC .. B05B 1/14; B05B 1/185; B05B 1/20; B05B 1/207; B05B 15/06; B05B 15/061; A62C 3/006; A62C 31/05; A62C 35/58; A62C 99/0009; F28C 3/005; F28C 3/08; F28D 5/02

See application file for complete search history.

(56) References Cited

U.S. PATENT DOCUMENTS 1,006,210 A * 10/1911 Heid ..... F23J 1/00 110/171
2,043,310 A * 6/1936 Thompson ..... A23L 3/06 426/407
2,555,230 A * 5/1951 Ford ..... A23L 3/10 426/403
3,983,260 A * 9/1976 Ford ..... A47J 27/08 126/377.1
4,632,089 A * 12/1986 Wardell ..... A47J 37/0704 126/152 B
6,047,694 A * 4/2000 Landstrom ..... A47J 27/04 126/25 C
6,386,093 B1 * 5/2002 Mackay ..... A47J 37/0786 126/25 R

* cited by examiner

*Primary Examiner* — Ryan A Reis
(74) *Attorney, Agent, or Firm* — Jason Bourgeois

(57) ABSTRACT

A system is provided for rapidly cooling a pot or boiler. The system includes a cylindrical or semi-cylindrical tube operatively connected to the pot or boiler. The tube also includes a means for attaching a water source or hose. Finally, the tube may also include a series of holes or nozzles for directing a stream or spray of water towards the outer surface of the pot or boiler. The system may be built into the pot or boiler or may be a standalone, removable and adjustable system for use on multiple different pots or boilers.

1 Claim, 3 Drawing Sheets

SYSTEM AND METHOD FOR EVAPORATIVE COOLING OF A HEATED APPARATUS

BACKGROUND

The invention relates generally to the field of evaporative/convective cooling of a metal boiler for culinary or industrial purposes.

DESCRIPTION OF RELATED ART

In certain circumstances, it is sometimes necessary to quickly cool metal pot boilers and industrial heating apparatuses by rapidly decreasing the temperature of their outer surface. In industrial applications, this is sometimes due to failure of a shutdown or safety mechanism that allows a temperature runaway. The boiler or cooker must be cooled in order to prevent damage to the machinery. Under such circumstances, it is not practical to open the apparatus as the contents are under high temperature and pressure; to do so would create an inordinate risk to personnel and property. Typically, cooling is achieved by slowly venting the contents, submerging the apparatus in water or spraying its outer surface with a hose.

In culinary applications, it is sometimes necessary to quickly reduce the temperature of a pot containing boiling liquid in order to avoid overcooking certain ingredients. For small volumes of liquid it is normally sufficient to remove the pot from the heat source, but for large volumes the relative surface area exposure is sufficiently small that the liquid will retain a high percentage of the heat energy for an unacceptable length of time. In order to arrest the cooking of the ingredients, practitioners will either add ice to the mixture or spray the outside of the pot with a garden hose. The former method has the adverse effect of watering down the mixture and thus reducing the overall impression of added spices; the latter is time consuming and inefficient.

While certain novel features of this invention shown and described below are pointed out in the claims, the invention is not intended to be limited to the details specified, since a person of ordinary skill in the relevant art will understand that various omissions, modifications, substitutions and changes in the forms and details of the invention illustrated and in its operation may be made without departing in any way from the spirit of the present invention. No feature of the invention is critical or essential unless it is expressly stated as being "critical" or "essential".

SUMMARY

The present invention provides a system and method for rapidly cooling a heated apparatus by exposing the outer surface of said apparatus to fluid spray or mist. An exemplary embodiment of the invention may comprise a system whereby a device which is roughly tailored to the outer dimensions of a specific apparatus is attached thereto by various means and whereby water or some other fluid is sprayed or misted onto the surface of said apparatus.

According to various embodiments, an apparatus, potentially a pot or boiler, is heated by an external heat source. In such an embodiment the apparatus may be composed of metal or some other heat conducting material. At such time as the user of the apparatus wishes to quickly reduce the temperature of the apparatus, the present invention may be affixed in such a way as to encircle the apparatus in a manner perpendicular to the long axis of the apparatus. In another embodiment, the present invention may be connected to a hose capable of delivering water or some other fluid with a high heat capacity. In such an embodiment, the present invention may be designed in such a way so as to apply such fluid in an even manner to the outer surface of the heated apparatus.

According to various embodiments, the present invention may be composed metal tubing and may be circular, rectangular or any other closed shape. In such embodiments, the present invention may be tailored to fit a specific apparatus and as such its shape may vary widely depending on the shape of said apparatus. Further, in such embodiments, the shape shall only be limited in such a way as to ensure a semi-closed system. Such a system may necessitate that the tubing create a loop wherein the distal end of the tube joins to the proximal.

According to various embodiments, the present invention may be composed of metal tubing tailored to a specific shape so as to fit a specific apparatus wherein the surface of the metal tubing facing the apparatus may have a series of holes disposed therein. Such holes may be disposed at a regular interval along the internal surface. Further, such holes may be nozzles designed to direct the flow of a fluid in a spray or a mist. In other embodiments, the present invention may constitute a semi-closed system in that it may be designed so that fluid entering the system may only escape by means of such holes.

According to various embodiments, the present invention may be affixed to a specific apparatus by various means. Such means may include instrumentalities for hanging the invention on the apparatus, adhesives, or may be permanently affixed to the apparatus by means of welding or molding.

While this disclosure provides certain specific embodiments, the invention is not limited to those embodiments. A person of ordinary skill in the art will appreciate from the description herein that modifications can be made to the described embodiments and therefore that the specification is broader in scope than the described embodiments. All examples are therefore non-limiting.

BRIEF DESCRIPTION OF THE DRAWINGS

The following drawings form part of the present specification and are included to further demonstrate certain aspects of the present invention. The invention may be better understood by reference to one or more of these drawings in combination with the description of specific embodiments presented herein.

DETAILED DESCRIPTION

Detailed descriptions of one or more embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate manner.

Whenever the phrase "for example" "such as," "including" and the like and used herein, the phrase "and without limitation" is understood to follow unless explicitly stated otherwise. Similarly "an example," "exemplary" and the like are understood to be non-limiting.

The terms "comprising" and "including" and "having" and "involving" (and similarly "comprises", "includes", "has", and "involves") and the like are used interchangeably and have the meaning. Specifically, each of the terms is defined consistent with the common United States patent law definition of "comprising" and is therefore interpreted to be an open term meaning "at least the following" and is also interpreted not to exclude additional features, limitations, aspects, etc. Thus, for example, "a process involving steps a, b, and c" means that the process includes at least steps a, b, and c.

Whenever the terms "a" or "an" are used, "one or more" is understood, unless such interpretation is nonsensical in context.

In certain industrial and culinary applications, it is advantageous to be able to quickly cool a heated fluid filled apparatus. This may be accomplished through evaporative cooling of the outer surface of the fluid filled apparatus. This method of cooling is particularly effective if the apparatus is composed of metal or some other heat conductive material. The present invention can be tailored to fit the outer surface of a specific apparatus so as to facilitate efficient evaporative cooling of the apparatus. The present invention may spray or mist water or some other fluid with a high heat capacity onto the apparatus by means of a series of regularly spaced nozzles along its inner surface.

Figure 1:
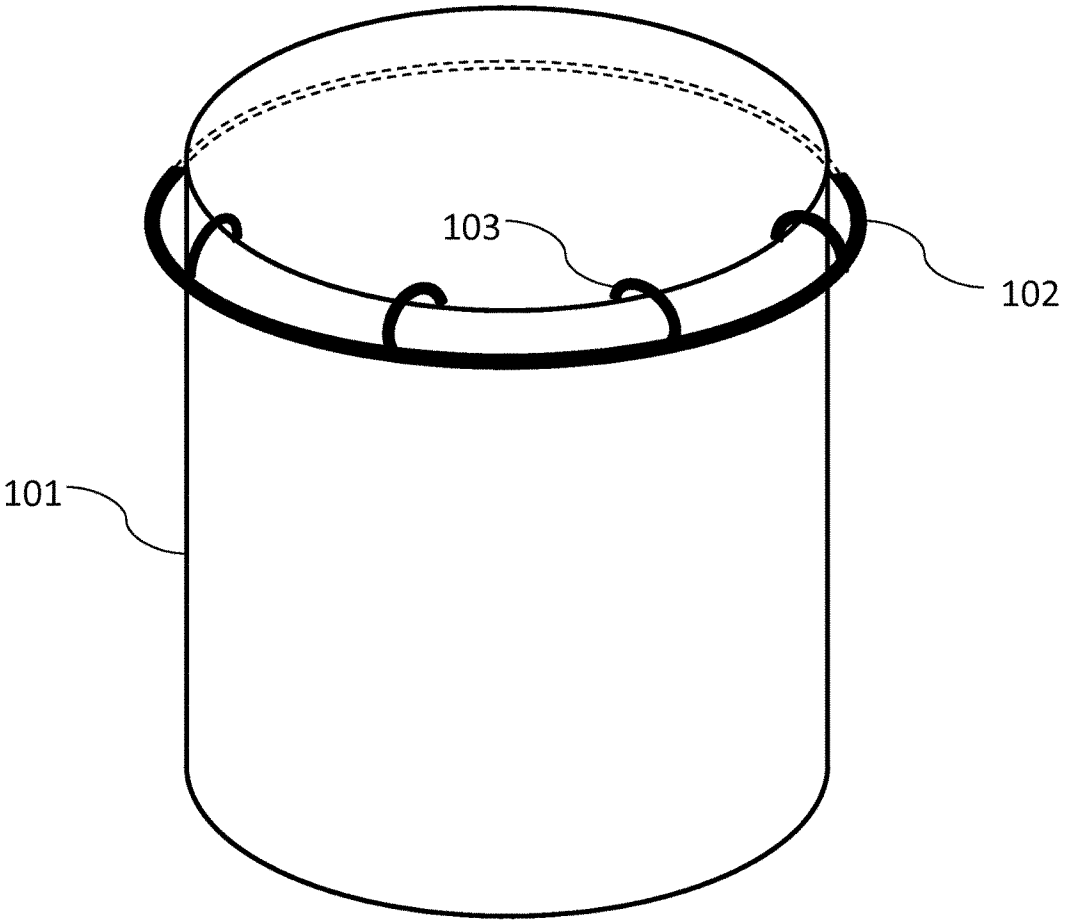
FIG. 1 is a depiction of the present invention mounted on an apparatus according to various embodiments.

Turning now to the figures. FIG. 1 is a depiction of the present invention mounted on an apparatus 101 according to various embodiments. Tubing 102 may be tailored to fit the apparatus 101 in such a way that it may fully encompass the external surface thereof.

Attachment means 103 may be configured in any way so as to allow tubing 102 to sit motionless at its user chosen position. Such attachment means 103 may include a hanging apparatus, an adhesive, or any other removable means. Further, such attachment means 103 may be permanent in the form of welding or molding onto said apparatus 101.

Figure 2:
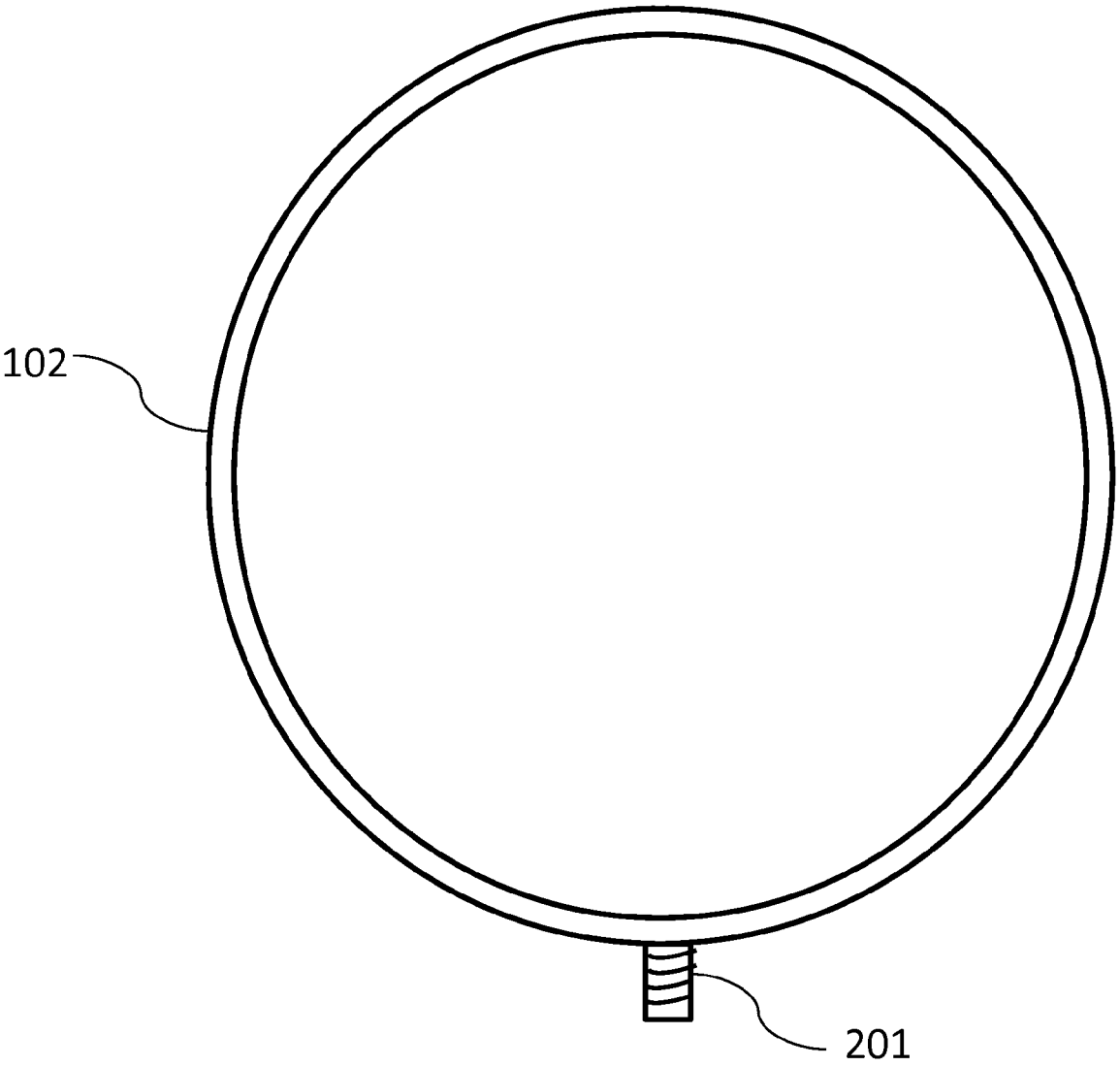
FIG. 2 is a depiction of the present invention and hose fitting according to various embodiments.

FIG. 2 is a depiction of the present invention and hose fitting 201 according to various embodiments. Hose fitting 201 may be of any configuration or dimension operative to connect to a hose used for delivering liquids.

Figure 3:
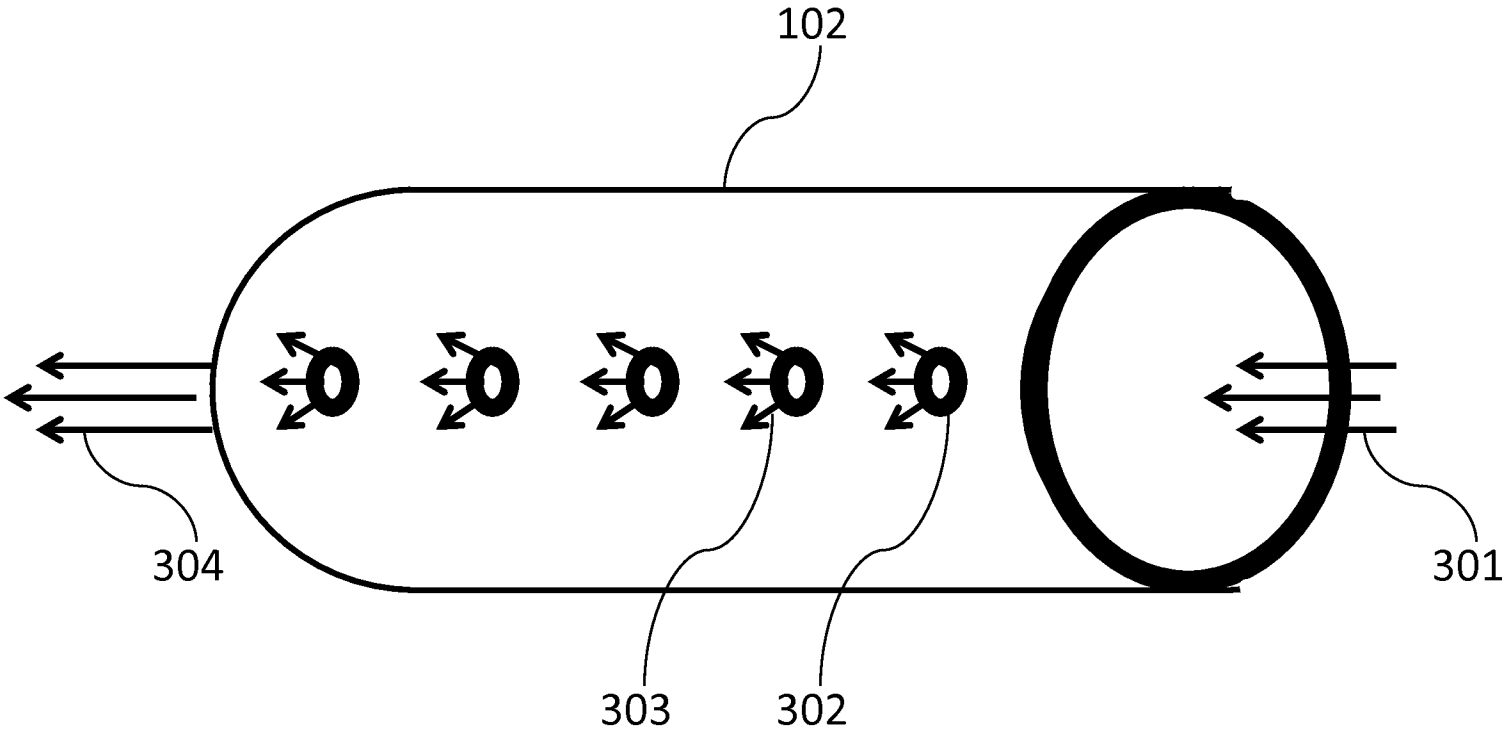
FIG. 3 is a depiction of the present invention demonstrating fluid flow through the tubing and the holes along the inner surface of the invention according to various embodiments.

FIG. 3 is a depiction of the present invention demonstrating fluid flow through the tubing 102 and the holes 302 along the inner surface of the invention according to various embodiments. Fluid 301 flows through tubing 102 and is dispersed 303 by means of holes 302. Such holes may be in the form of nozzles operative to create a spray or mist of liquid. Such fluid that is not dispersed 304 continues through tubing 102 to be dispersed later in the series of holes lining the inner surface of said tubing.

EQUIVALENTS

Those skilled in the art will recognize, or be able to ascertain using no more than routine experimentation, many equivalents to the specific embodiments of the present invention described herein. Such equivalents are intended to be encompassed by the following claim.

All publications, patents, and patent applications mentioned in this specification are herein incorporated by reference into the specification to the same extent as if each individual publication, patent or patent application was specifically indicated to be incorporated herein by reference.

Other embodiments are in the claims.

What is claimed is:

1. A method for cooling a pot boiler comprising:

affixing a ring of metal tubing to said pot boiler, said ring of metal tubing having a series of nozzles disposed along its inner circumference, said ring of metal tubing further having a hose fitting operative to accept and regulate the flow of water;

attaching a hose to said ring of metal tubing by means of said hose fitting;

causing water to flow into said ring of metal tubing; and said water being directed by said nozzles onto the outer surface of said pot boiler.

* * * * *